United States Patent [19]

Seagrave

[11] Patent Number: 4,749,137

[45] Date of Patent: Jun. 7, 1988

[54] STRAND ACCUMULATOR WITH ROTATABLE DRUM AND ROLLS

[75] Inventor: Earl M. Seagrave, Mooresville, N.C.

[73] Assignee: Nokia Corporation, Helsinki, Finland

[21] Appl. No.: 113,647

[22] Filed: Oct. 26, 1987

[51] Int. Cl.[4] ..... B65H 51/22

[52] U.S. Cl. ..... 242/47.1; 242/47.01; 242/47.12

[58] Field of Search ..... 242/47.01, 47.08, 47.09, 242/47.1, 47.11, 47.12, 47.13, 47, 54 R, 25 R, 78, 82

[56] References Cited

U.S. PATENT DOCUMENTS

| | | | |
|---|---|---|---|
| 2,380,526 | 7/1945 | Hoagland | 242/47.1 |
| 2,755,916 | 7/1956 | McIlvried et al. | 242/47.12 |
| 3,050,267 | 8/1962 | Tragert | 242/47.1 |
| 3,078,055 | 2/1963 | Harris | 242/47.12 |
| 3,637,149 | 1/1972 | Frei | 242/47.09 |
| 3,687,384 | 8/1972 | Rosen | 242/47.12 |
| 3,796,386 | 3/1974 | Tannert | 242/47.12 |
| 4,132,367 | 1/1979 | Ineson et al. | 242/47.1 |
| 4,641,794 | 2/1987 | Yamazaki et al. | 242/47.01 |

*Primary Examiner*—Stanley N. Gilreath

*Attorney, Agent, or Firm*—Bell, Seltzer, Park & Gibson

[57] ABSTRACT

A strand accumulator apparatus for the transitory accumulation of moving strand material is disclosed which includes a strand accumulator drum and first and second sets of rolls carried by the accumulator drum and arranged in a generally circular pattern about the central axis of the drum with a plurality of grooves formed in the peripheral surface of each roll. First and second guide means cooperate with first and second sets of rolls to guide the incoming and outgoing strands of material to and from the rolls of the accumulator drum. The accumulator drum is rotated about its central axis in one direction to accumulate strand and in the opposite direction to pay out the accumulated strand.

18 Claims, 3 Drawing Sheets

STRAND ACCUMULATOR WITH ROTATABLE DRUM AND ROLLS

BACKGROUND OF THE INVENTION

This invention relates to strand winders and in particular to a strand accumulator which accumulates a moving strand material.

In the manufacturing and processing of strand material, such as steel wire, textile yarn, rope or fiber optic cable for example, a portion of the manufacturing or processing line may often stop or slow relative to the remainder of the line, due to strand breaks, winding reel changes or the necessity of parts replacement in certain production machines. For example, a fiber optic cable is processed through drawing devices, testing machinery and finally to a winding device for winding the fiber optic cable on a bobbin or spool. Periodically, the spool must be replaced with an empty spool and replacement can take less than a minute. It is not feasible, however, to stop the entire processing line in order to change a winding reel spool. Therefore, it is common practice to provide an accumulator between the winding reel and an adjacent processing station so that while the spool is being changed, processed strand is fed onto the accumulator. When the spool change is complete, the accumulated strand is withdrawn from the accumulator and wound onto the spool.

Heretofore, most prior art strand accumulators have required a very large space, typically extending vertically several stories high to serve as a type of looping pit for the strand material. Some improvements have been made so as to lessen the vertical height an accumulator extends. An example is U.S. Pat. No. 4,641,794 to Yamazaki, which discloses a wire accumulator where a revolving arm distributes strand material on concentric grooves formed on two sets of circularly arranged rolls. Strand tension and speed is controlled by an appropriate apparatus located on the revolving arm.

Although devices such as disclosed in Yamazaki provide an accumulator which is a more compact unit with less vertical height than many other prior art devices, the rotating arm carrying a tension and speed control apparatus is complex and creates mechanical difficulties in operation.

It is accordingly an object of the present invention to provide a strand accumulator having a compact size requiring a low vertical height as well as a minimum amount of floor space coverage.

Another object of the present invention is to provide a strand accumulator having a strand tension control apparatus which is simple and efficient in operation.

SUMMARY OF THE INVENTION

These and other objects and advantages of the present invention are accomplished by a strand accumulator apparatus for the transitory accumulation of moving strand material and wherein the apparatus includes a generally cylindrical strand accumulator drum mounted for rotation about a central axis. A first set of rolls is carried by the accumulator drum and is arranged in a generally circular pattern about the central axis of the drum. A second set of rolls is carried by the accumulator drum adjacent to the first set of rolls and is also arranged in a generally circular pattern about the central axis of the drum. A plurality of grooves are formed in the peripheral surfaces of each of the rolls for receiving and guiding a strand.

A first guide means cooperates with the first set of rolls and guides an incoming strand onto the first set of rolls. The strand material then passes from one of the rolls of the first set into the interior of the drum and transfers to one of the rolls of the second set where the strand travels along a path of travel generally opposite the strand's direction of travel over the first set of rolls. A second guide means cooperates with the second set of rolls and guides the outgoing strand material off of the second set of rolls. Means are provided for rotating the generally cylindrical accumulator drum about its central axis in either direction, so that as the drum is rotated in a first direction the first and second sets of rolls revolve about the central axis of the drum and successive wraps of the running strand are wound about the first and second sets of rolls to thereby accumulate the moving strand in the apparatus, and so that when the drum is rotated in the opposite direction, accumulated strand wound about the rolls is paid out by the apparatus.

In the preferred embodiment, means are provided for traversing the first and second guide means in timed relation with the rotation of the accumulator drum so as to position the strand into successive grooves on the rolls with each wrap of the strand about the sets of rolls. Means are also included for rotating each roll in the first set in a common direction and at the same peripheral rate of speed so that the strand material which is directed onto the rolls is advanced around the periphery of the respective rolls of the first set. Means for rotating each roll in the second set in a common direction and at the same peripheral rate of speed but in a direction opposite to the direction of rotation of the rolls of the first set are provided so the advancing strand material which is received from the first set of rolls is advanced around the periphery of the second set of rolls.

BRIEF DESCRIPTION OF THE DRAWINGS

Some of the objects and advantages of the present invention having been stated, others will be more fully understood from the detailed description which follows and by reference to the accompanying drawings in which.

DETAILED DESCRIPTION OF THE PREFERRED EMBODIMENT

Figure 1:
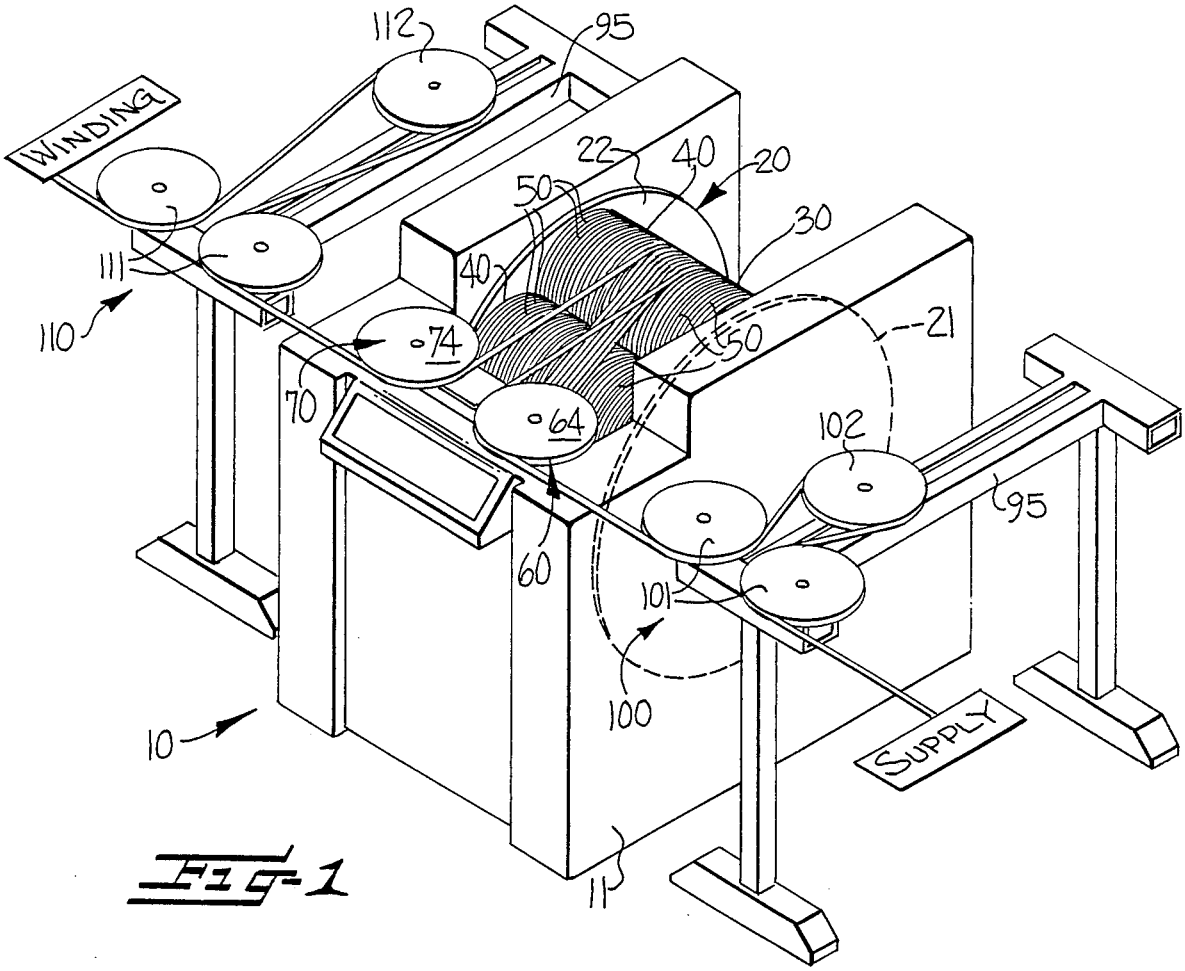
FIG. 1 is a perspective view of the strand accumulator apparatus.
Figure 2:
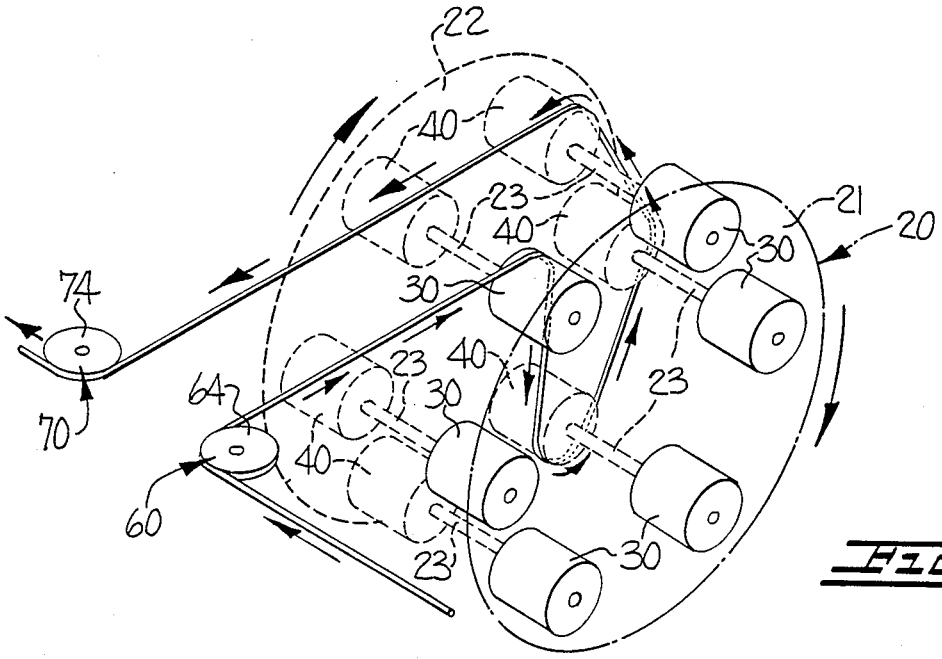
FIG. 2 is a perspective view showing in schematic format the rolls arranged in a circular pattern about the central axis of the strand accumulator drum.

Referring more particularly to the drawings, and FIGS. 1 and 2, a preferred embodiment of the strand accumulator apparatus 10 is shown positioned between a strand supply, which could be any of the processing steps found in strand manufacturing, and a final winding reel. The apparatus 10 includes a generally cylindrical strand accumulator drum 20 mounted for rotation about a central axis within a housing 11. The housing 11 shields and protects the drum 20 as well as other moving parts and motors. The housing 11 also protects a worker from injurious moving parts within the accumulator 10 while a worker operates a control panel 12 located at the front of the housing 11. A first set of rolls 30 is carried by the accumulator drum 20 and arranged in a generally circular pattern about the central axis of the drum, while a second set of rolls 40 is carried by the accumulator drum 20 adjacent to the first set of rolls 30 and also arranged in a generally circular pattern about the central axis of the drum 20. Formed on the surface of each of the rolls are a plurality of grooves 50 for receiving and guiding a strand therein.

A first guide means 60 cooperates with the first set of rolls 30 for guiding an incoming strand onto the first set of rolls 30. As best seen in FIG. 2, the strand material then passes off one of the rolls 30 of the first set and through the interior of the drum 20 to transfer to one of the rolls 40 of the second set, where the strand reverses direction and continues its travel along a path generally parallel to but opposite the path of travel of the incoming strand. A second guide means 70 cooperates with the second set of rolls 40 to guide the outgoing strand material off of the second set of rolls 40. Means for rotating the drum about its central axis in either direction is provided, so that as the drum 20 is rotated in a first direction, or clockwise as illustrated, the first and second sets of rolls 30,40 revolve about the central axis of the drum and successive wraps of the running strand material are wound within the grooves about the first and second sets of rolls 30,40 to accumulate strand material. When the drum 20 is rotated in the opposite direction, or counterclockwise as illustrated, the accumulated strand material in paid out.

Figure 3:
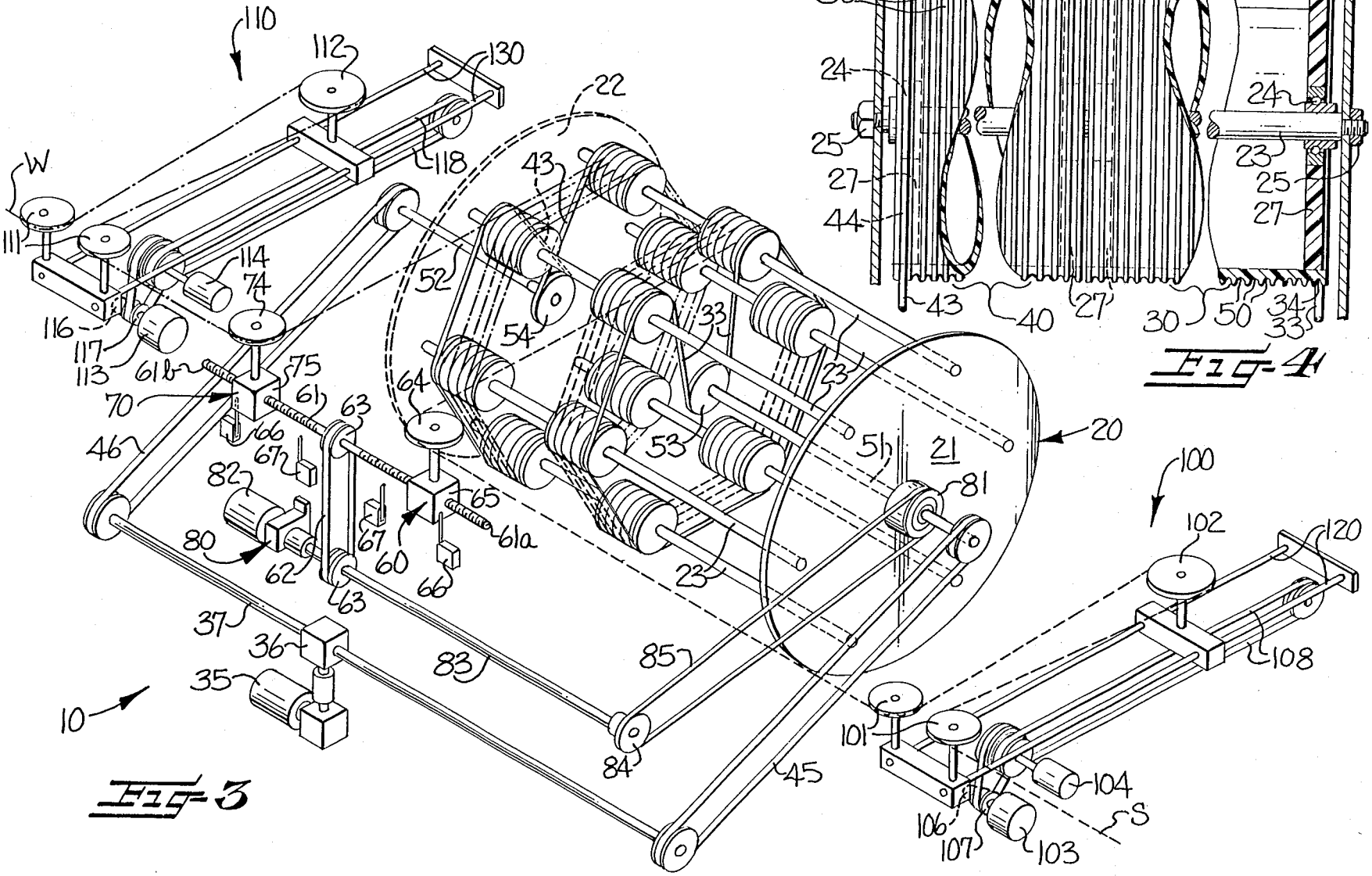
FIG. 3 is a perspective view with parts exploded showing various drive mechanisms for the drum, rolls and dancers.

Referring now more particularly to FIGS. 1-3, the rotatable drum 20 includes first and second end walls 21,22 at either end of the drum which are in parallel facing arrangement to each other. Each end wall is mounted to the housing 10 and rotatable thereon with the line joining the centers of rotation of the two sides 21, 22 forming a central axis. Six shafts 23 are mounted inside the drum 20 and transversely extend across the drum 20 parallel to the central axis of the drum. One end of each shaft 23 is secured to the first end wall 21 and the other end of each shaft 23 is secured to the second end wall 22. The shafts 23 are arranged substantially equidistantly from each other in a generally circular pattern about the central axis of the drum 20.

The first and second sets of rolls 30,40 each include six rolls, with a roll in each set mounted for rotation upon the shafts 23. The rolls 30 of the first set are mounted adjacent the first end wall 21 while the rolls of the second set are mounted adjacent to the rolls 30 and the second end wall 22 so that each roll in the first set 30 is in coaxial alignment with a corresponding roll in the second set 40, and with the inner ends of the corresponding rolls positioned adjacent one another.

Figure 4:
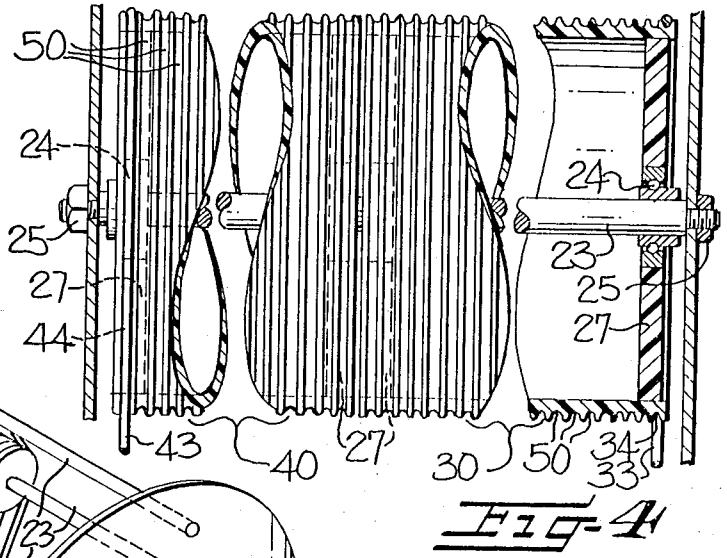
FIG. 4 is a plan view in partial sectional cutaway showing the grooves formed in the peripheral surface of each roll.

In the illustrated embodiment, each roll 30,40 is produced from twelve inch diameter plastic pipes about eighteen inches long. End walls 27 close the open ends of the pipe and are secured to the pipe by any of the appropriate fastening means common in the art such as heat sealing, ultrasonic welding or gluing. A plurality of concentric grooves 50 are formed on each roll. In the preferred embodiment, twenty grooves 50 are formed on each roll. It has been found that machining the grooves while turning the roll on a lathe is inexpensive but efficient. The rolls 30,40 are mounted on the shafts 23 for rotation by appropriate bearings 24 while the shafts 23 are secured to the end walls 21,22 by a threaded shaft and nut assembly 25 (FIG. 4).

Means are provided for rotating each roll 30 in the first set in a common direction and at the same peripheral rate of speed and means are provided for rotating each roll 40 in the second set in a common direction and at the same peripheral rate of speed but in a direction opposite to direction of rotation of the rolls of the first set. As illustrated, the rotation of the first set of rolls 30 is achieved by a drive belt 33 operatively engaging a peripheral portion of each roll 30 in the first set. Similarly, drive belt 43 operatively engages a peripheral portion of each roll 40 in the second set. The drive belts 33,43 engage an annular groove 34,44 formed on the outer end of the first and second sets of rolls 30,40 (FIGS. 3 and 4). The drive belts 33,43 may be any of the common elastomeric belts used in the industry and which is adapted for such use.

The respective drive belts 33,34 are driven by pulley rolls 53,54 carried by first and second rotatable shafts 51,52 which extend along the central axis of the drum 20. First and second drive pulleys 45,46 interconnect the rotatable shafts 51,52 with a common drive shaft 37 driven by a motor 35 and transmission 36. The second drive belt 43 is twisted a half-turn on its pulley roll 54 so that rotation of the crankshaft 37 causes a rotation of first and second set of rolls 30,40 at the same speed but in a direction opposite to each other.

The drum is rotated about its central axis in either direction by a drive means 80 which engages a drum pulley 81 carried by the wall 21 of the drum 20. A hole for permitting the first shaft 51 to extend freely through pulley 81 is provided and may include insert bearings (not shown). The drive means includes a reversible motor 82, drive shaft 83 and a roller pulley 84 secured to the end of the drive shaft 83 with a belt 85 interconnecting the roller pulley 84 and drum pulley 81 secured onto the first end wall 21. In operation, the motor 82 turns the shaft 83 which via the belt 85 rotates the drum 20 about its center axis. When the drum 20 rotates clockwise as illustrated, the strand material is accumulated. Counterclockwise drum rotation causes the strand material to pay out from the accumulator.

When accumulating, the strand must accumulate on successive grooves 50 of the rolls with each wrap of the strand about the set of rolls. For each rotation of the drum 20, the first and second guide means 60,70 must traverse a distance equal to the distance between successive grooves 50 on the sets of rolls 30,40. Thus, means are provided for traversing the first and second guide means 60,70 in timed relation with the rotation of the accumulator drum 20. The traversing means includes a rotatable shaft 61 mounted transversely along the length of the drum 20 and positioned adjacent with the drive shaft 83. The rotatable shaft 61 has two threaded ends 61*a*,61*b* with one end 61*b* having left handed threads and the other end 61*a* having right handed threads. A belt 62 and pulley rolls 63 interconnect the drive shaft 83 and threaded shaft 61. The first and second guide means 60,70 include, respectively, an infeed and outfeed guide roll 64,74 for receiving and directing the strand in a different direction from its initial path of entry or exit and a first and second guide roll housing 65,75 supporting the guide rolls 64,74 with the housings 65,75 adapted to traverse upon the threaded shaft 61 when the shaft 61 is turned.

The ratio of the belt 63 and pulley rolls 62, as well as the pitch of the threads (not shown) is established so that with each revolution of the drum 20 in a direction to accumulate, both housings 65,75 with rolls 64,74 traverse outward a distance equal to the distance between adjacent concentric grooves 50. Since each of the six rolls in a set are spaced apart from adjacent rolls approximately one sixth of a complete revolution, each groove 50 is laterally spaced from a groove 50 in a successive roll in the same set a distance equal to one-sixth the distance between adjacent grooves 50 formed on the same roll. Limit switches 66 are positioned at either end of the threaded shaft 61 to prevent the over accumulation of strand material in the accumulator 10. When the accumulator has rotated so that the housings 65,75 have traversed to the end of the threaded shaft 61 to contact the limit switches 66, a cut-off signal is generated to stop any accumulating since the accumulator 10 has been filled to capacity. Limit switches 67 are also provided at the inner limits of the guide housing's travel to prevent the housings 65,75 from traveling too far inwardly.

For regulating the speed and direction of the accumulator drum 20 rotation as well as the speed of the roll 30,40 rotation, control means is provided which includes a first tension means, generally indicated at 100, for sensing tension of the incoming strand and a second tension means, generally indicated at 110, for sensing tension of the outgoing strand withdrawn from the second set of rolls. The tension means 100,110 include two pairs of pulley rolls, an infeed pair 101 and an outfeed pair 111, mounted adjacent to each other on a frame 95, with the infeed and outfeed pulley rolls 101,111 mounted in linear alignment with the guide rolls 64,74. Respective infeed and outfeed dancer rolls 102,112 are positioned adjacent the respective infeed and outfeed pulley rolls 101,111 to form a triangular arrangement. As shown by the dashed line in FIG. 3, the incoming strand is fed around the first infeed pulley roll 101, around the dancer roll 102 and around the other infeed pulley roll 101. The outgoing strand is similarly threaded through the outfeed pulley rolls 111 and cooperating outfeed dancer roll 112.

Figure 5:
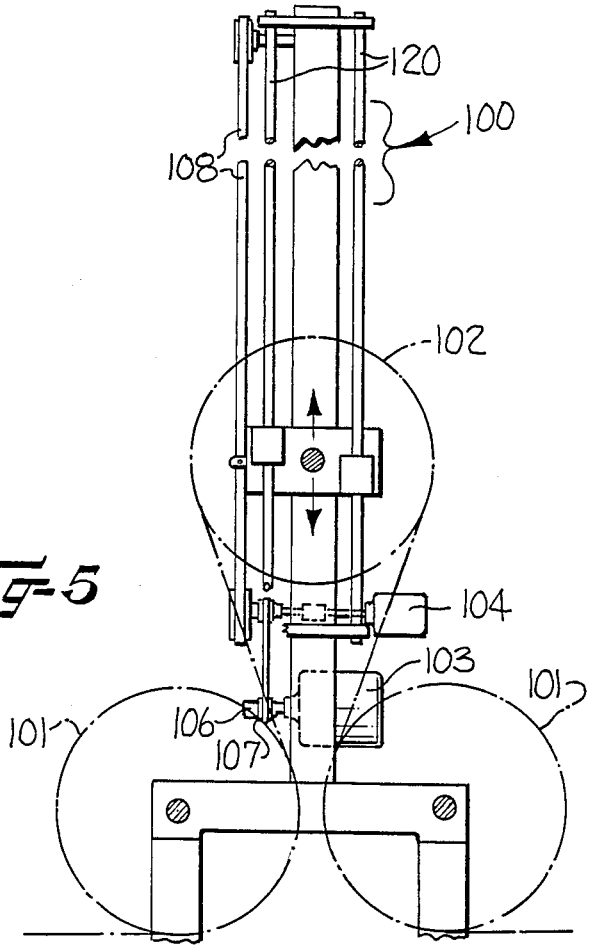
FIG. 5 is a plan view in partial schematic of a dancer roll arrangement.

The dancer rolls 102,112 are mounted for movement in response to variations in tension on the strand. A constant torque motor 103,113 with clutches 106,116 and drive pulleys 107,117 provide a constant force to the dancer rolls 102,112 in a direction away from the infeed and outfeed pulleys 101,111 so that if strand tension is decreased, the dancer rolls 102,112 move on a track 120,130 away from the infeed and outfeed pulley rolls 101,111. As best seen in FIG. 5, infeed and outfeed potentiometers 104,114 are drivingly connected by a belt arrangement 108,118 so as to be rotated in response to movement of the dancer rolls. The potentiometers thus provide varying output voltage depending on the position of the dancer rolls 102,112. The output voltage varies from 0 volts at the neutral position (the intermediate or midpoint position of the dancer roll to positive five volts at its farthest point of travel away from the fixed pulley rolls 101,111 and negative five volts at the nearest point of travel to the fixed pulley rolls 101,111. Drum 20 rotation is determined by the cumulative voltage of the two potentiometers 104,114. A cumulative positive voltage between the two potentiometers creates a rotation of the drum 20 in a direction to accumulate, while a negative cumulative voltage creates a reverse rotation of the drum to pay out strand. Change in the speed of rotation of the rolls is determined by the difference or offset in dancer roll position. When the rolls are offset from one another, this indicates an imbalance condition and the roll speed is increased or decreased accordingly until the imbalance condition no longer exists.

In the initial strand feed-through within the accumulator, both infeed and outfeed dancers 102,112 are in a neutral position (FIG. 6) With the infeed and outfeed guide rolls 64,74 positioned in their most inward position towards each other. The strand initially comes from a processing area or supply and feeds through the infeed pulley rolls 101 and dancer roll 102, feeds transversely across a length of the drum 20 to the infeed guide roll 64. From the infeed guide roll 64 the strand passes onto the innermost groove 50 of one of the rolls in the first set 30 through the interior of the drum 20 to transfer to one of the innermost grooves 50 of the second set 40. The strand continues along the innermost grooves 50 of two successive rolls in the second set 40 to the outfeed guide roll 74, changes direction to extend transversely across a length of the drum 20 to feed into the outfeed pulley rolls 111 and dancer roll 112. The strand is then collected on a winder W. It is understood that the initial feed-through of a strand must be hand fed. Once the strand is fed, the accumulator is ready for operation.

Figure 6:
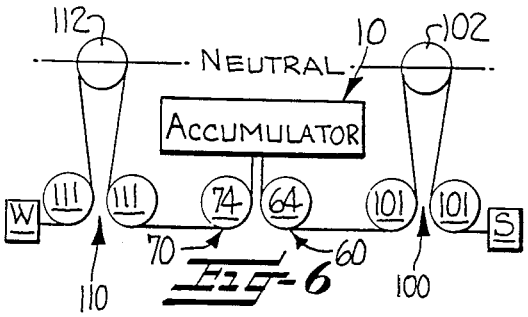
FIG. 6 is a plan view in schematic of the arrangement of the dancer rolls in a neutral position.
Figure 9:
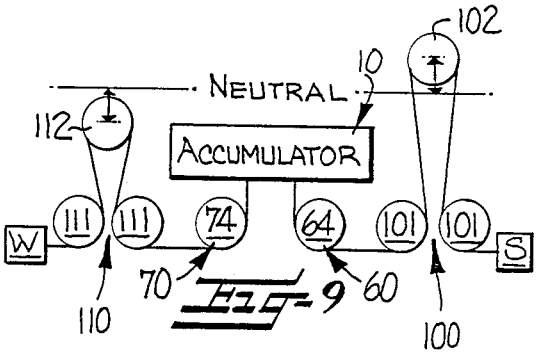
FIG. 9 is a plan view in schematic of the arrangement of the dancer rolls when roll rotation speed will increase.

At first start up, the processing line, winder and accumulator are stopped. Both dancer rolls 102,112 are in a neutral position as shown in FIG. 6 with the infeed and outfeed guide rolls 64,74 positioned at their most inward position. Simultaneously, the processing of the strand begins while the winder begins to take up. The supply strand feeding from the processing area creates a lower tension on the incoming strand which causes the infeed dancer roll 102 to move away from the infeed rolls 101. The start of the winding reel creates increased tension on the strand coming from the accumulator. The increased tension causes the outfeed dancer rolls 112 to move toward the outfeed pulley rolls 111. The rolls are offset from one another as shown in FIG. 9. This offset or imbalance condition will bring about an increase in roll speed. After the roll speed is increased sufficiently, the rolls reassume a neutral position, and a steady state condition is achieved with the strand moving through the accumulator at a rate equal to the supply speed and winding speed.

Figure 7:
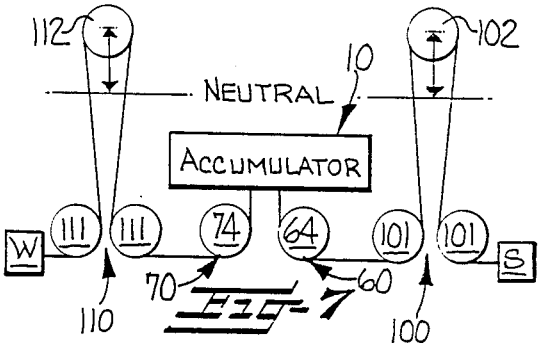
FIG. 7 is a plan view in schematic of the arrangement of the dancer rolls when the drum is accumulating at its fastest speed.

The dancers 102,112 are able to accommodate other strand processing situations where either excess slack or tension is created. For example, during the strand processing, the spool on the winding reel is periodically changed. Since it is not feasible to stop the processing line for short periods, such as during a spool change, the drum 20 must rotate in a direction to accumulate strand. When the winder is stopped, the reduction in tension causes movement of the dancer rolls 102,112 as shown in FIG. 7. The constant tension exerted on the dancers 102,112 by the motors 103,113 causes the dancers to move to their most forward limit away from the infeed and outfeed pulleys 101,111 creating a net positive cumulative voltage. The positive voltage causes the drum 20 to rotate in a positive direction for accumulating strand.

Figure 8:
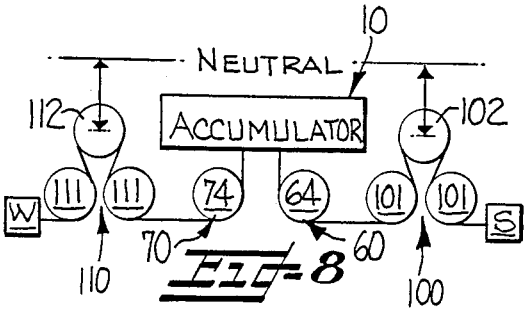
FIG. 8 is a plan view in schematic of the arrangement of the dancer rolls when the drum is paying out.

FIG. 8 is illustrative of a situation where the winding speed is faster than the strand speed fed from the processing line. As a result, increased tension is placed upon the infeed and outfeed dancers 102,112 creating a cumulative negative voltage. The drum 20 rotates in a direction to pay out any accumulated strand and the extra paid out strand allows the dancers to return to a neutral position to stabilize the process.

FIG. 9 illustrates the situation when the rolls 30,40 are moving too slowly. This imbalance condition causes an increase in roll speed.

Figure 10:
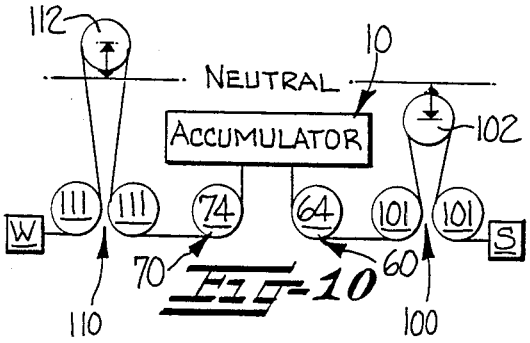
FIG. 10 is a plan view in schematic of another arrangement of the dancer rolls when roll rotation speed will decrease.

FIG. 10 illustrates a situation where the roll speed is too fast.

It is understood that the foregoing description of the various positions of the dancer rolls 102,112 and the resulting speeds and rotations of the rolls 30,40 and drum 20 can occur simultaneously and over short periods of time. In one instant the drum 20 may be rotating with the rolls 30,40 rotating at a set speed, but because of a processing change occurring in a short period of seconds, drum and roll speed and rotation can change accordingly.

The foregoing embodiments are to be considered illustrative rather than restrictive of the invention and those modifications which come within and range of equivalents of the claims to be included therein.

That which is claimed is:

1. A strand accumulator apparatus for the transitory accumulation of moving stand material comprising a generally cylindrical strand accumulator drum mounted for rotation about a central axis, a first set of rolls carried by said accumulator drum and arranged in a generally circular pattern about the central axis of said drum, a second set of rolls carried by said accumulator drum adjacent to said first set of rolls and also arranged in a generally circular pattern about the central axis of said drum, a plurality of grooves formed in the peripheral surface of each of said rolls for receiving and guiding a strand therein, first guide means cooperating with said first set of rolls for guiding an incoming strand onto said first set of rolls, the strand thereafter passing from one of the rolls of said first set interiorly of the drum to transfer to one of the rolls of said second set, second guide means cooperating with said second set of rolls for guiding the outgoing strand off of said second set of rolls, and means for rotating said generally cylindrical accumulator drum about its central axis in either direction, so that as the drum is rotated in a first direction the first and second sets of rolls revolve about said central axis of said drum and successive wraps of the running strand are wound about said first and second sets of rolls to thereby accumulate the moving strand in the apparatus, and so that when the drum is rotated in the opposite direction accumulated strand wound about said rolls is paid out by the apparatus.

2. The stand accumulator as claimed in claim 1 including means for traversing said first and second guide means in timed relation with the rotation of said accumulator drum so as to position the strand into successive grooves on said rolls with each wrap of the strand about the sets of rolls.

3. The strand accumulator as claimed in claim 2 wherein said means for traversing said first and second guide means traverses said first guide means in a direction opposite to the traversing direction of the second guide means.

4. The strand accumulator as claimed in claim 1 including means for rotating each roll in said first set in a common direction and at the same peripheral rate of speed so that the strand material which is directed onto said rolls is advanced around the periphery of the respective rolls of said first set, and means for rotating each roll in said second set in a common direction and at the same peripheral rate of speed but in a direction opposite to the direction of rotation of the rolls of said first set so that advancing strand material which is received from said first set of rolls is advanced around the periphery of said second set of rolls.

5. The strand accumulator as claimed in claim 4 wherein said means for rotating each roll in the respective first and second sets includes a first drive means operatively engaging each roll in the first set and a second drive means operatively engaging each roll in the second set.

6. The strand accumulator as claimed in claim 5 wherein said first drive means includes a drive belt operatively engaging a peripheral portion of each roll in the first set and said second drive means includes a drive belt operatively engaging a peripheral portion of each roll in the second set.

7. The strand accumulator as claimed in claim 1 wherein said first and second sets of rolls are equal in number and are mounted to said accumulator so that each roll in said first set is in coaxial alignment with a roll in said second set.

8. The strand accumulator as claimed in claim 1 wherein said rolls in each set are arranged in the circular pattern substantially equidistantly from each other.

9. The strand accumulator as claimed in claim 1 wherein said plurality of grooves formed in the surface of each roll of said first and second sets comprise a series of side-by-side annular grooves longitudinally spaced from one another along the axis of each roll thereof.

10. The strand accumulator as claimed in claim 1 including control means for regulating the speed and direction of the accumulator drum rotation and the speed of the roll rotation.

11. The strand accumulator as claimed in claim 10 wherein said control means includes a first tension means for sensing tension of the incoming strand and a second tension means for sensing tension of the outgoing strand withdrawn from the second set of rolls.

12. The strand accumulator as claimed in claim 11 wherein said first and second tension means each includes a dancer roll mounted for movement in response to variations in tension on the strand, and means responsive to the movement of the respective dancer rolls for regulating the speed and direction of rotation of the accumulator drum and the speed of the first and second sets of rolls.

13. A strand accumulator apparatus for the transitory accumulation of moving strand material comprising a generally cylindrical strand accumulator drum mounted for rotation about a central axis a first set of rolls carried by said accumulator drum and arranged substantially equidistantly from each other in a generally circular pattern about the central axis of the drum, a second set of rolls carried by said accumulator drum and arranged substantially equidistantly from each other in a generally circular pattern about the central axis of the drum, the rolls of said second set being mounted alongside the rolls of said first set so that each roll in said second set is in coaxial alignment with a corresponding roll in the first set, and with inner ends of the corresponding roles positioned adjacent one another, a plurality of grooves formed in the peripheral surface of each roll of said first and second sets for receiving and guiding a strand therein, first guide means cooperating with said first set of rolls for guiding an incoming strand onto an inner end portion of the first set of rolls, the strand thereafter passing from one of the rolls of said first set interiorly of the drum to transfer to an inner end portion of one of the rolls of the second set, second guide means cooperating with the second set of rolls for guiding the outgoing strand off of the second set of rolls, means for rotating said generally cylindrical accumulator drum about its central axis in either direction, so that as the drum is rotated in a first direction the first and second sets of rolls revolve about said central axis of said drum and successive wraps of the running strand are wound about said first and second sets of rolls beginning adjacent the inner ends of both sets of rolls and proceeding outwardly to the outer ends to thereby accumulate the moving strand in the apparatus, and so that when the drum is rotated in the opposite direction, accumulated strand wound about said rolls is paid out by the apparatus, and means for traversing said first and second guide means along a path parallel to the central axis of said drum in timed relation with the rotation of said accumulator drum so as to position the strand into successive grooves on said rolls with each wrap of the strand about the sets of rolls.

14. A strand accumulator apparatus for the transitory accumulation of moving strand material comprising a housing, a generally cylindrical strand accumulator drum mounted for rotation within said housing about a central axis, and including a wall at each end of said drum extending perpendicular to the axis of rotation of the drum, a plurality of shafts carried by the end walls of said drum and arranged substantially equidistantly from each other in a generally circular pattern about and parallel to the central axis of the drum, first and second sets of rolls mounted for rotation on said shafts, the rolls of the first set being mounted alongside the rolls of the second set so that each roll in the first set is in coaxial alignment with a corresponding roll in the second set, and with inner ends of the corresponding rolls positioned adjacent one another, a plurality of grooves formed in the peripheral surface of each roll of said first and second sets, a first guide roll carried by said housing and mounted for guiding an incoming strand onto an inner end portion of the first set of rolls, the strand thereafter passing from one of the rolls of the first set interiorly of the drum to transfer to an inner end portion of one of the rolls of the second set, a second guide roll carried by said housing and mounted for guiding the outgoing strand off of the second set of rolls means for rotating said accumulator drum about its central axis in either direction so that as the drum is rotated in a first direction the first and second sets of rolls revolve about said central axis of said drum and successive wraps of the running strand are wound about said first and second set of rolls beginning adjacent the inner ends of both sets of rolls and proceeding outwardly to the outer ends to thereby accumulate the moving strand in the apparatus, and so that when the drum is rotated in the opposite direction, accumulated strand wound about said rolls is paid out by the apparatus, means for rotating each roll of said first and second sets, first and second tension means for sensing tension of the incoming strand directed onto the first set of rolls and of the outgoing strand withdrawn from the second set of rolls, said first and second tension means each including a dancer roll mounted for movement in response to variations in tension on the strand, and means responsive to the movement of the dancer rolls for regulating the speed and direction of rotation of the accumulator drum and the speed of rotation of the sets of rolls.

15. A method of accumulating moving strand material comprising guiding an incoming strand along a predetermined path of travel onto the periphery of a first set of rolls arranged in a circular pattern about a central axis, transferring the moving strand from the periphery of the first set of rolls and onto the periphery of a second set of rolls arranged in a circular pattern about said central axis, guiding the outgoing strand from the second set of rolls along a predetermined path of travel opposite the path of travel of the incoming strand and to a separate area for subsequent processing, simultaneously moving said first and second sets of rolls in an orbital path about said central axis so that with each revolution of the rolls in one direction, successive wraps of the running strand are wound about the first and second sets of rolls to thereby accumulate the moving strand, and so that with each revolution of the rolls in the opposite direction, accumulated strand wound about the rolls is paid out.

16. A method as claimed in claim 15 including the steps of rotating each roll in the first set in the same direction and at the same peripheral rate of speed for advancing the strand which is directed onto the first set of rolls, and rotating each roll in the second set in the same direction and at the same peripheral rate of speed but in a direction opposite to the direction of rotation of the rolls so that the advancing strand which is received from the first set of rolls is advanced around the periphery of the second set of rolls.

17. A method as claimed in claim 16 including the steps of sensing the tension of the incoming strand and of the outgoing strand, and controlling the speed and direction of orbital movement of said first and second sets of rolls in response to sensed changes of tension of the strand.

18. A method as claimed in claim 17 including the step of also controlling the speed of rotation of said rolls in response to sensed changes of tension of the strand.

* * * * *

UNITED STATES PATENT AND TRADEMARK OFFICE

CERTIFICATE OF CORRECTION

PATENT NO. : 4,749,137

DATED : June 7, 1988

INVENTOR(S) : Earl M. Seagrave

It is certified that error appears in the above-identified patent and that said Letters Patent is hereby corrected as shown below:

Column 3, line 48, "in" should be -- is --.

Column 6, line 22, "With" should be -- with --.

Column 7, line 37, "stand" should be -- strand --.

Column 8, line 1, "stand" should be -- strand --.

Signed and Sealed this

Thirteenth Day of December, 1988

*Attest:*

DONALD J. QUIGG

*Attesting Officer*

*Commissioner of Patents and Trademarks*